US006896116B2

(12) United States Patent
Deaville et al.

(10) Patent No.: US 6,896,116 B2
(45) Date of Patent: May 24, 2005

(54) BILL ACCEPTOR

(75) Inventors: David C. Deaville, West Chester, PA (US); Joseph A. Simpkins, West Chester, PA (US); Edward M. Zoladz, Jr., West Chester, PA (US); John Snider, West Chester, PA (US)

(73) Assignee: Mars Incorporated, McLean, VA (US)

( * ) Notice: Subject to any disclaimer, the term of this patent is extended or adjusted under 35 U.S.C. 154(b) by 160 days.

(21) Appl. No.: 10/174,182

(22) Filed: Jun. 18, 2002

(65) Prior Publication Data

US 2003/0230464 A1 Dec. 18, 2003

(51) Int. Cl.[7] ..... G07F 7/04
(52) U.S. Cl. ..... 194/206; 194/350
(58) Field of Search ..... 194/206, 205, 194/207, 215, 216, 217, 350

(56) References Cited

U.S. PATENT DOCUMENTS

| | | | | | |
|---|---|---|---|---|---|
| 4,374,557 | A | * | 2/1983 | Sugimoto et al. | 194/215 |
| 4,628,194 | A | | 12/1986 | Dobbins et al. | 235/379 |
| 5,113,990 | A | | 5/1992 | Gabrius et al. | 194/206 |
| 5,360,134 | A | | 11/1994 | Falk et al. | 221/2 |
| 5,411,249 | A | | 5/1995 | Zouzoulas | 271/181 |
| 5,630,755 | A | * | 5/1997 | Walsh et al. | 700/91 |
| 5,836,435 | A | | 11/1998 | Fujita et al. | 194/206 |
| 5,889,883 | A | | 3/1999 | Simpkins | 382/135 |
| 6,038,491 | A | | 3/2000 | McGarry et al. | 700/231 |
| 6,044,952 | A | | 4/2000 | Haggerty et al. | 194/207 |
| 6,135,887 | A | | 10/2000 | Pease et al. | 463/42 |
| 6,142,284 | A | * | 11/2000 | Saltsov | 194/207 |
| 2002/0063035 | A1 | * | 5/2002 | Blad et al. | 194/350 |

FOREIGN PATENT DOCUMENTS

| | | | |
|---|---|---|---|
| EP | 1043699 A1 | 10/2000 | G07D/5/00 |
| EP | 1045351 A2 | 10/2000 | G07F/11/00 |
| EP | 0888594 B1 | 4/2002 | G07D/7/00 |
| WO | WO 02/33668 A2 | 4/2002 | G07F/7/04 |

* cited by examiner

*Primary Examiner*—Donald P. Walsh
*Assistant Examiner*—Mark J. Beauchaine
(74) *Attorney, Agent, or Firm*—Fish & Richardson P.C.

(57) ABSTRACT

A bill acceptor module may receive configuration data from at least one of an interface board, a programming tool, a plug-in memory, a memory on a currency cassette, and a host machine, store the configuration data in a memory, and process signals according to the configuration data to enable operation of the bill acceptor module with a host machine. The operation of the bill acceptor module may include communication with a currency cassette.

85 Claims, 7 Drawing Sheets

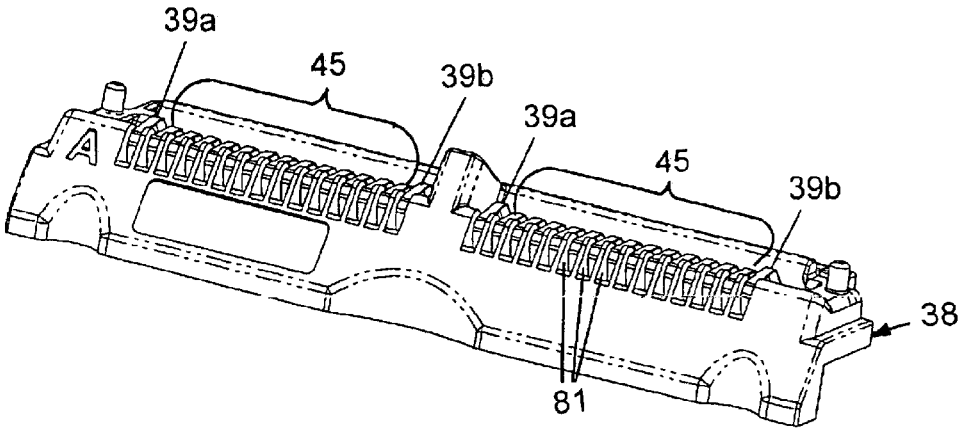
FIG. 8
FIG. 9
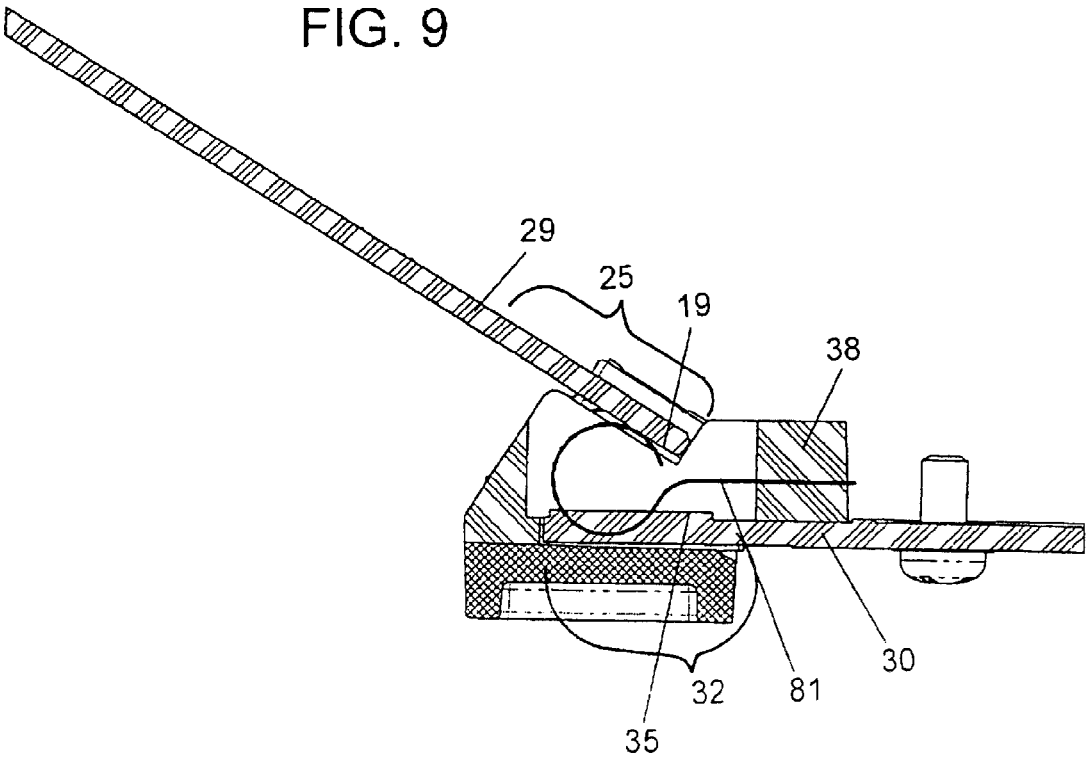

BILL ACCEPTOR

TECHNICAL FIELD

This application relates generally to a bill acceptor.

BACKGROUND

In industries, such as gaming or vending, a host machine is manufactured to include a printed circuit board (PCB) that uses hardware and software interfaces developed by the manufacturer of the host machine. A host machine may be coupled to a compatible bill acceptor. The bill acceptor must be manufactured to be compatible with that host machine's hardware and software interfaces. Because most host machine manufacturers use different hardware and software interfaces, in order to increase market share, manufacturers of bill acceptors must produce a plurality of models to ensure compatibility with each type of host machine.

SUMMARY

In an aspect, the invention features a method and apparatus for storing data for a bill acceptor module in a memory of an interface board. The configuration data is transmitted to the bill acceptor module to enable operation of the bill acceptor module with a host machine. The interface board includes an interface printed circuit board with electrical connections for coupling a bill acceptor module to a host machine. The interface board also includes control circuitry coupled to the interface printed circuit board. A memory may be coupled to the interface printed circuit board to store information that, when applied to the control circuitry, causes the control circuitry to store configuration data for a bill acceptor module in a memory of an interface board and transmit the configuration data to the bill acceptor module to enable operation of the bill acceptor module with the host machine.

In another aspect, the invention features a method and apparatus for receiving configuration data transmitted from at least one of an interface board apparatus, a programming tool, a plug-in memory, a memory on a currency cassette, and a host machine in a bill acceptor module. The bill acceptor module stores the configuration data in a memory. The bill acceptor processes signals according to the configuration data to enable operation of the bill acceptor module with the host machine. The bill acceptor module includes a printed circuit board with electrical connections to couple to an interface board apparatus. The bill acceptor module also includes control circuitry coupled to the printed circuit board. A memory may be coupled to the printed circuit board to store information that, when applied to the control circuitry, causes the control circuitry to receive configuration data transmitted from at least one of an interface board apparatus, a programming tool, a plug-in memory, a memory on a currency cassette, and a host machine, store the configuration data in a memory, and process signals according to the configuration data to enable operation of the bill acceptor module with a host machine.

In another aspect, the invention features a system including a frame, an interface board that may be removably mounted in the frame, and a bill acceptor module. The interface board may include an interface printed circuit board with electrical connections, control circuitry and associated memory coupled to the interface printed circuit board. The memory of the interface board stores information that causes the control circuitry to store configuration data for a bill acceptor module in a memory of an interface board, and to transmit the configuration data to the bill acceptor module to enable operation of the bill acceptor module with a host machine. A bill acceptor module may include a printed circuit board with electrical connections to couple to the interface board. The bill acceptor module also may include control circuitry and associated memory coupled to the printed circuit board. The memory of the bill acceptor module stores information that causes the control circuitry to receive configuration data transmitted from at least one of an interface board, a programming tool, a plug-in memory chip, a memory on a currency cassette, and a host machine, store the configuration data, and process signals according to the configuration data to enable operation of the bill acceptor module with the host machine.

Embodiments may include one or more of the following. The interface board may receive a request from the bill acceptor module to transmit the configuration data. The interface board may also receive configuration data transmitted from the bill acceptor module, which the bill acceptor module received from at least one of a plurality of sources. The configuration data that is transmitted to the bill acceptor module to enable operation of the bill acceptor module with a host machine may be specific to at least one of a host machine type or an individual host machine. In embodiments, operation of the bill acceptor module with the host machine includes receiving a message in host machine protocol, converting the message to a standard protocol, and transmitting the message to the bill acceptor module in the standard protocol.

In another aspect, in addition to storing data for a bill acceptor module in a memory of an interface board, and transmitting the configuration data to the bill acceptor module to enable operation of the bill acceptor module with a host machine, currency cassette data may be received in the interface board apparatus. The interface board may transmit the currency cassette data to the bill acceptor module. The interface board may use RF communications to receive the currency cassette data. The interface board may also receive information for the currency cassette from the bill acceptor module and transmit the information to the currency cassette. The interface board may transmit the information to the currency cassette using RF communications.

In another aspect, in addition to storing data for a bill acceptor module in a memory of an interface board, and transmitting the configuration data to the bill acceptor module to enable operation of the bill acceptor module with a host machine, the interface board may receive a request from a bill acceptor module to operate an electrical apparatus on a currency cassette and send a request to the electrical apparatus on the currency cassette to perform a function.

In another aspect, in addition to receiving configuration data transmitted from at least one of an interface board apparatus, a programming tool, a plug-in memory, a memory on a currency cassette, and a host machine, storing the configuration data in a memory, and processing signals according to the configuration data to enable operation of the bill acceptor module with the host machine, the bill acceptor may also send a request to the interface board apparatus to transmit the configuration data. In embodiments, the bill acceptor may also receive configuration data from at least one of a plurality of sources and transmit the configuration data to the interface board apparatus. In embodiments, the operation of the bill acceptor module with the host machine includes receiving a message from an interface board apparatus according to a host machine protocol and converting the message to a standard protocol. The bill acceptor module may receive currency cassette data from the interface board apparatus. The bill acceptor may also transmit information from the bill acceptor module to the currency cassette via the interface board apparatus. The bill acceptor module may receive data from a currency cassette or transmit data to a currency cassette. RF communications may be used to receive or transmit the data. The bill acceptor module may send a request to an interface board apparatus to operate an electrical apparatus. The electrical apparatus may include a currency cassette electromechanical lock and the request may include at least one of locking and unlocking the electromechanical lock.

In embodiments the electrical connections of the printed circuit board of the interface board are compatible with at least one of many types of adapters. The interface board may be one of a plurality of interface board models, each of which is capable of converting one or more host interfaces to a standard interface. The interface board may include DIP switches to set and store configuration data.

The interface board may include a connector mounted on the interface printed circuit board for connection to a printed circuit board of a bill acceptor module. The connector includes an array of spring-like metallic fingers for contacting at least one of the electrical connections on the interface printed circuit board and electrical connections on the printed circuit board of the bill acceptor module. At least one outermost metallic finger is raised to make contact with a corresponding electrical connection on a printed circuit board before any of the other metallic fingers make contact. An electrical circuit on the printed circuit board corresponding to the outermost metallic finger is ruggedized to withstand electrostatic discharge.

In embodiments, at least one outermost electrical connection pad of the interface printed circuit board is raised, such that it is higher than other electrical connection pads, to make contact with a corresponding metallic finger on a connector before any other electrical connection pad makes contact. An electrical circuit on the interface printed circuit board corresponding to the raised pad is ruggedized to withstand electrostatic discharge. Alternatively, at least one outermost electrical connection pad of the interface printed circuit board is elongated, such that it is longer than the other electrical connection pads, to make contact with a corresponding metallic finger on a connector before any other electrical connection pad makes contact. An electrical circuit on the interface printed circuit board corresponding to the elongated pad is ruggedized to withstand electrostatic discharge. The interface board apparatus may include an RF antenna coupled to the interface board for receiving currency cassette data or transmitting data to the currency cassette using RF communications.

In embodiments, the electrical connections of the bill acceptor module's printed circuit board are compatible with at least one of many types of connectors. The bill acceptor module may include a USB adapter coupled to the electrical connections of the printed circuit board. The USB adapter is accessible even when the bill acceptor module is mounted to the frame.

The bill acceptor module may include a connector mounted on the printed circuit board for connection to an interface printed circuit board of an interface board apparatus. The connector includes an array of spring-like metallic fingers for contacting at least one of the electrical connections on the interface printed circuit board of the interface board apparatus and the electrical connections on the printed circuit board of the bill acceptor module. At least one outermost metallic finger is raised to make contact with a corresponding electrical connection on a printed circuit board before any of the other metallic fingers make contact. An electrical circuit on a printed circuit board corresponding to the outermost metallic finger is ruggedized to withstand electrostatic discharge.

In embodiments, at least one outermost electrical connection pad of the printed circuit board is raised, such that it is higher than other electrical connection pads, to make contact with a corresponding metallic finger on a connector before any other electrical connection pad makes contact. An electrical circuit on the interface printed circuit board corresponding to the raised pad is ruggedized to withstand electrostatic discharge. Alternatively, at least one outermost electrical connection pad of the printed circuit board is elongated, such that it is longer than other electrical connection pads, to make contact with a corresponding metallic finger on a connector before any other electrical connection pad makes contact. An electrical circuit on the interface printed circuit board corresponding to the elongated pad is ruggedized to withstand electrostatic discharge.

In another aspect, the printed circuit board includes electrical connections to couple directly to a host machine and the memory further includes instructions to cause the control circuitry to communicate directly with the host machine. The bill acceptor module utilizes a standard interface to receive its configuration data. An Edge card connector may be used to couple directly to a host machine and for connection to a host machine.

One or more of the following features may also be included. The electrical apparatus on the currency cassette may be an electromechanical lock. The configuration data may include information regarding at least one of a stacker configuration, power up policy, bezel type, enabled bill denominations, bill acceptance method, banknote series restriction, user interface and user interface auto-detect.

Embodiments may have one or more of the following advantages. A gaming machine on a crowded casino floor that is open while a service technician is replacing and configuring the machine's bill acceptor is vulnerable to theft. By allowing a bill acceptor module to receive its configuration data from an interface board, the methods and devices of the present technique minimize the service time and therefore increase the security of the machine. Also, future host machine designs may be accommodated with minimal disruption. Other advantages of the present methods and devices are the mechanical elements of the electrical interconnections of each PCB are provided at a low cost and with a high reliability and original equipment manufacturers, gaming machine manufacturers, distributors and end users must only handle one variant of bill acceptor.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 8 is an isometric view of an interface connector according to one embodiment of the invention.

FIG. 9 is a cross-sectional view of an interface connector according to one embodiment of the invention.

Like reference symbols in the various drawings indicate like elements.

DETAILED DESCRIPTION

Figure 1:
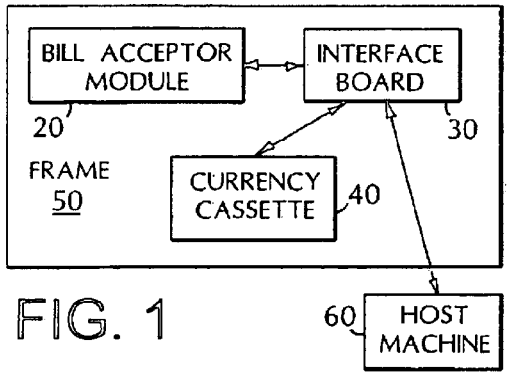
FIG. 1 is a simplified block diagram illustrating a system that includes a currency validator assembly according to an embodiment of the invention.

FIG. 1 is a simplified block diagram of a currency validator assembly 10 that may include of a bill acceptor module 20, interface board apparatus 30, currency cassette 40, and frame 50. FIGS. 2–5 illustrate an embodiment of the various components of the currency validator assembly 10. The frame 50 may be fixedly mounted using screws or equivalent means in a host machine 60, such as a gaming machine. The bill acceptor module 20 may be removably mounted to the frame 50 and may be inserted or removed independently of the other components.

Figure 2:
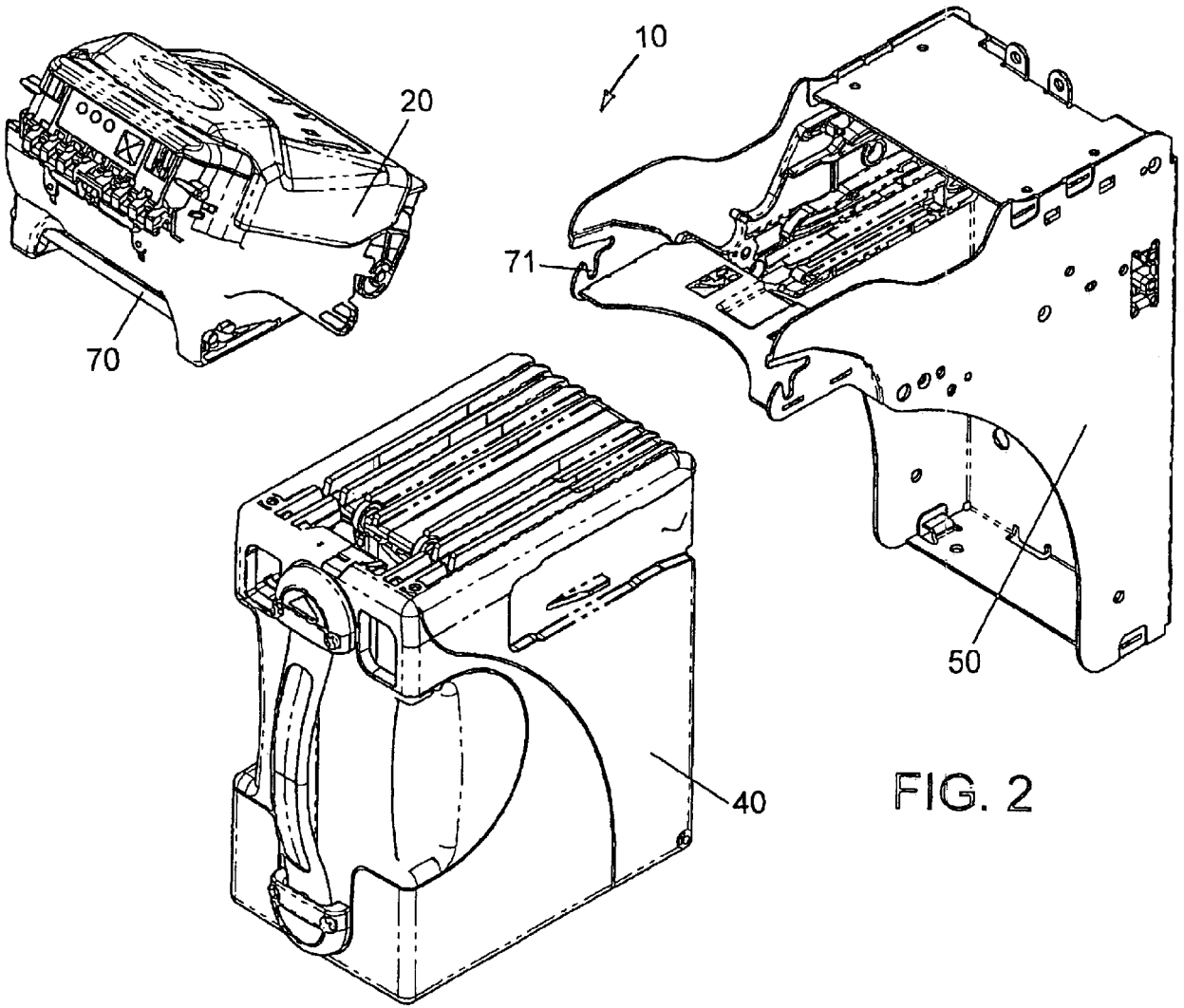
FIG. 2 is an exploded, isometric view of a bill acceptor module, a frame, and a currency cassette according to an embodiment of the invention.

Referring to FIG. 2, the bill acceptor module may include a rod 70 for removable connection to a slot or indent 71 in frame 50. Service personnel may wish to remove the bill acceptor module 20 in the event of a malfunction or for routine maintenance, such as cleaning. The currency cassette 40 may also be removably attached to the frame 50 independently of the other components. During normal operation, the currency cassette 40 may be removed from the frame 50 according to a regular schedule. An empty currency cassette 40 may be inserted into the frame 50 to replace the removed currency cassette.

Figure 3:
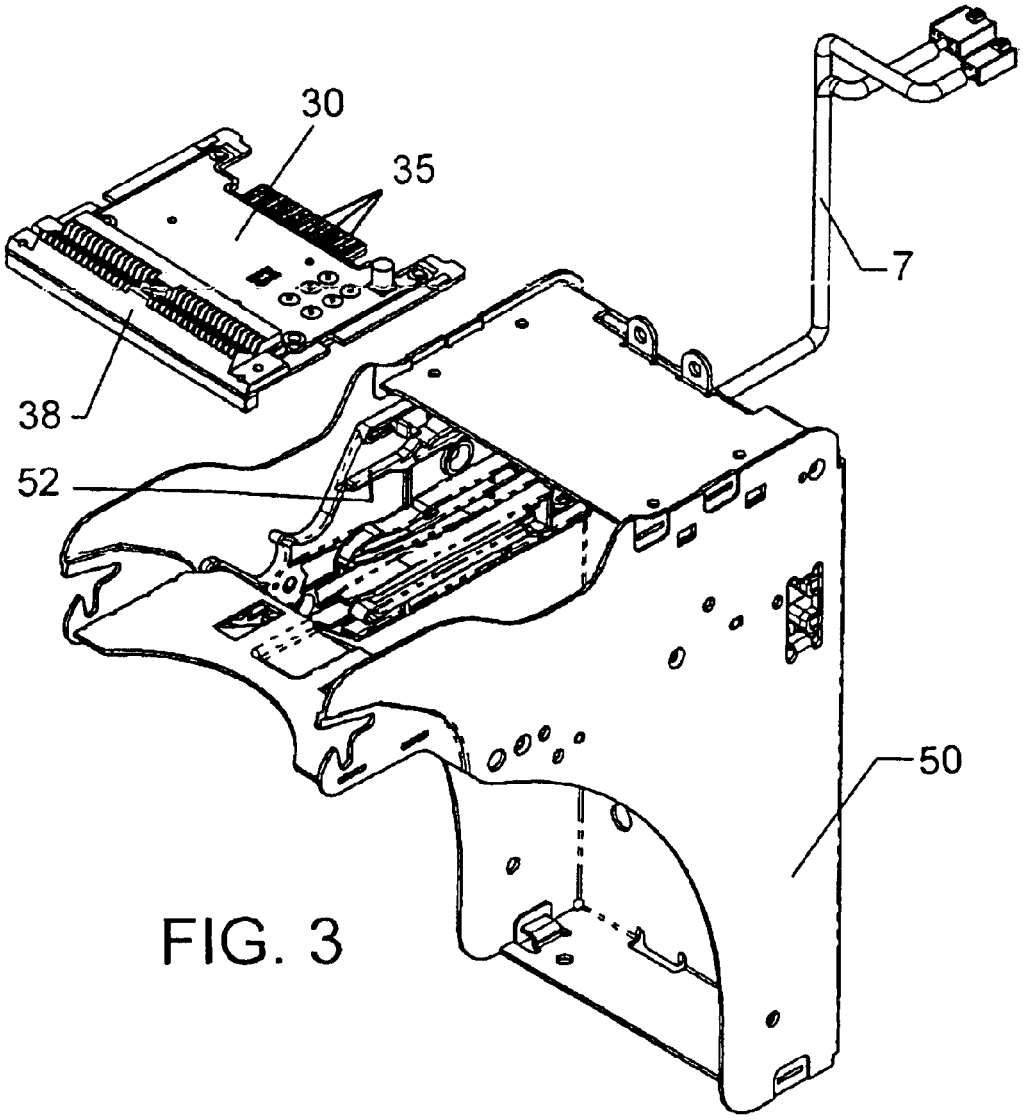
FIG. 3 is an exploded view of an interface board and a frame according to one embodiment of the invention.
Figure 4:
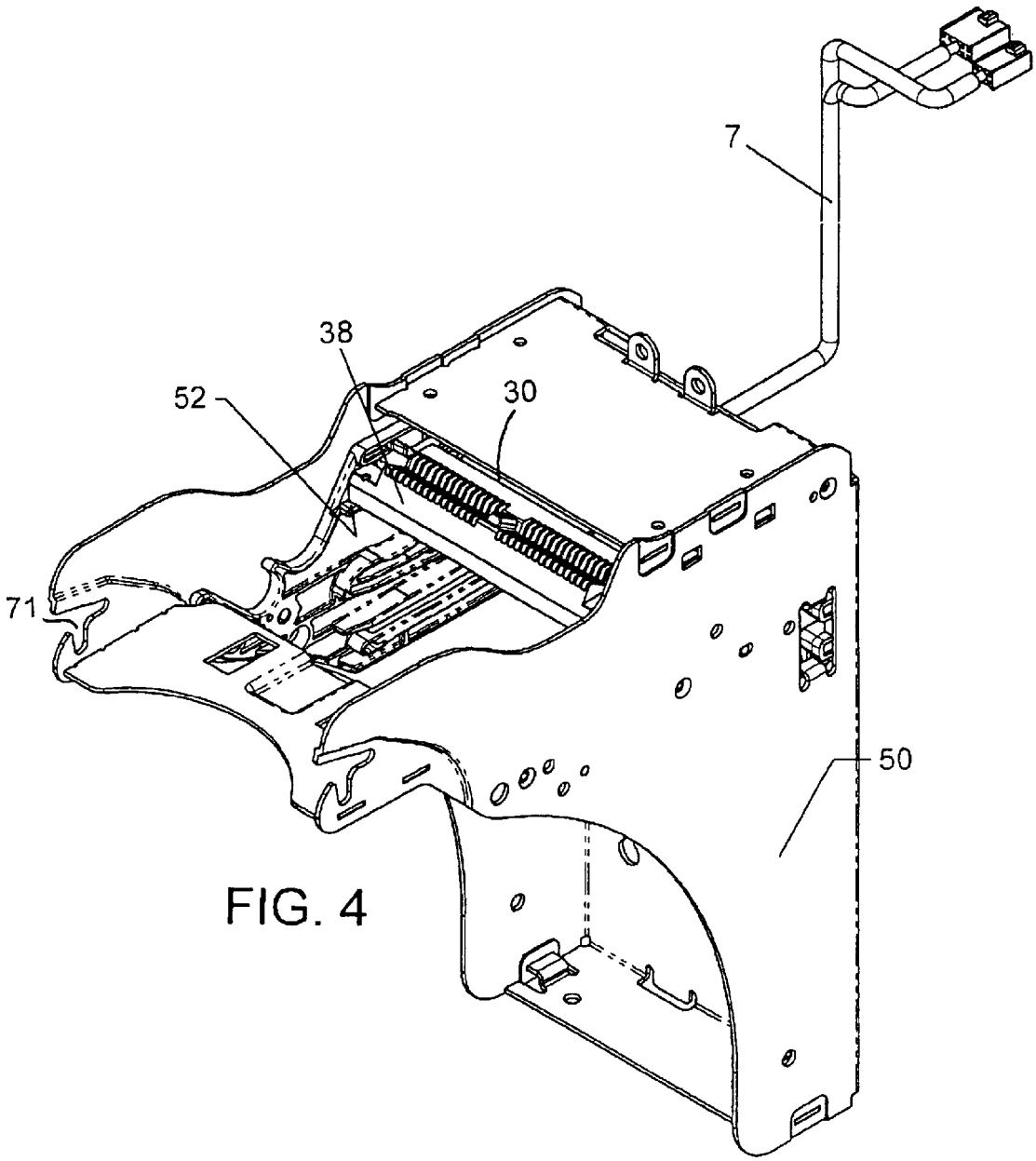
FIG. 4 illustrates the interface board of FIG. 3 mounted in the frame.

Referring to FIG. 3, an interface board 30 may also be removably mounted to the frame 50, and is shown removed from the frame. A connector 38 may be mounted using screws or equivalent means to the interface board 30. The interface board 30 is inserted into the frame 50 on the mounting rails 52. FIG. 4 depicts a connector 38 mounted to the interface board 30 which is mounted to the frame 50. The connector 38 is accessible on the side closer to the indent 71. Upon removal of the bill acceptor module 20, the interface board 30 may be removed from the frame 50 independently of the other components for repair or replacement. However, the interface board 30 is not intended to be frequently removed from the frame 50.

Figure 5:
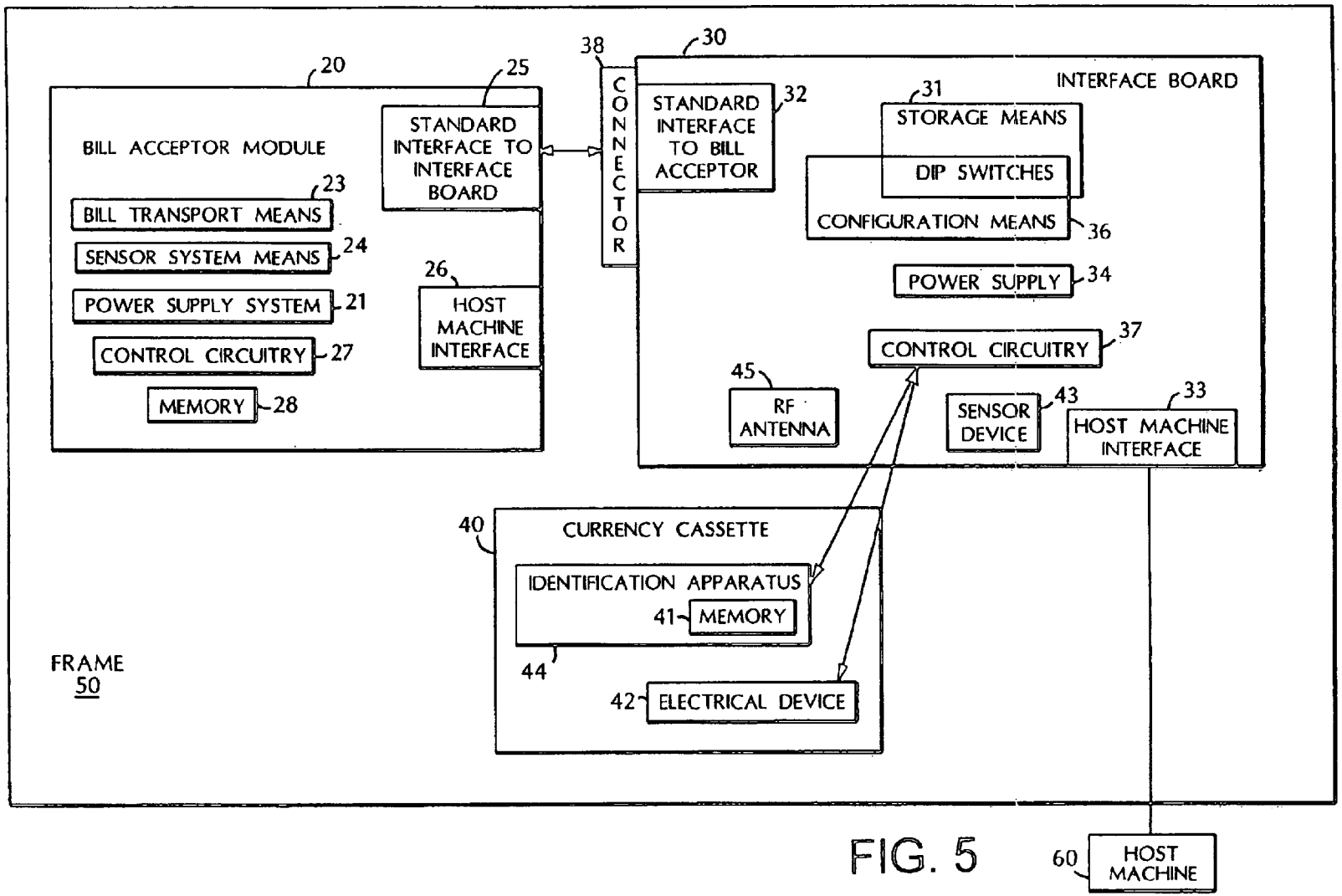
FIG. 5 is a simplified block diagram illustrating details of each component of a system that includes a currency validator assembly according to an embodiment of the invention.

Referring to FIG. 5, a bill acceptor module 20 may include at least a power supply system 21, control means, such as control circuitry 27, which may include a processor or gate array, bill transport means 23, sensor system means 24, and one or more host machine interfaces 26 to connect to a host machine. The bill acceptor 20 also includes a host independent standard interface 25 to connect to an interface board 30. The control circuitry 27 may be coupled to a printed circuit board (PCB) to execute instructions stored in a memory 28. The details of bill validation including bill transport are beyond the scope of the present application, but can be found for example in U.S. Pat. No. 4,628,194 (controlling means), U.S. Pat. No. 5,411,249 (bill transport means), and U.S. Pat. Nos. 5,889,883 and 6,004,952 (sensor system means) which are assigned to the assignee of this case.

Figure 6:
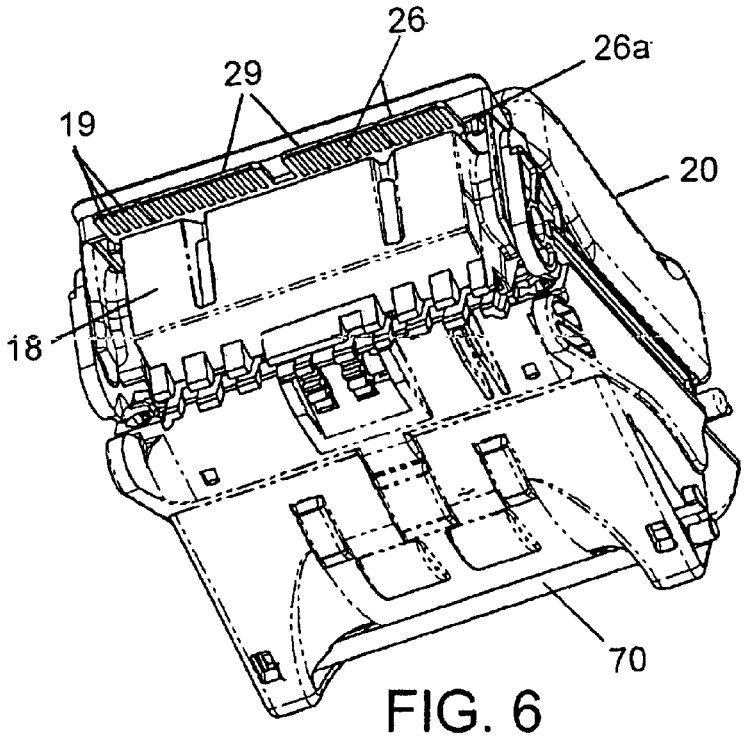
FIG. 6 is a rear isometric view of a bill acceptor module according to an embodiment of the invention.
Figure 7:
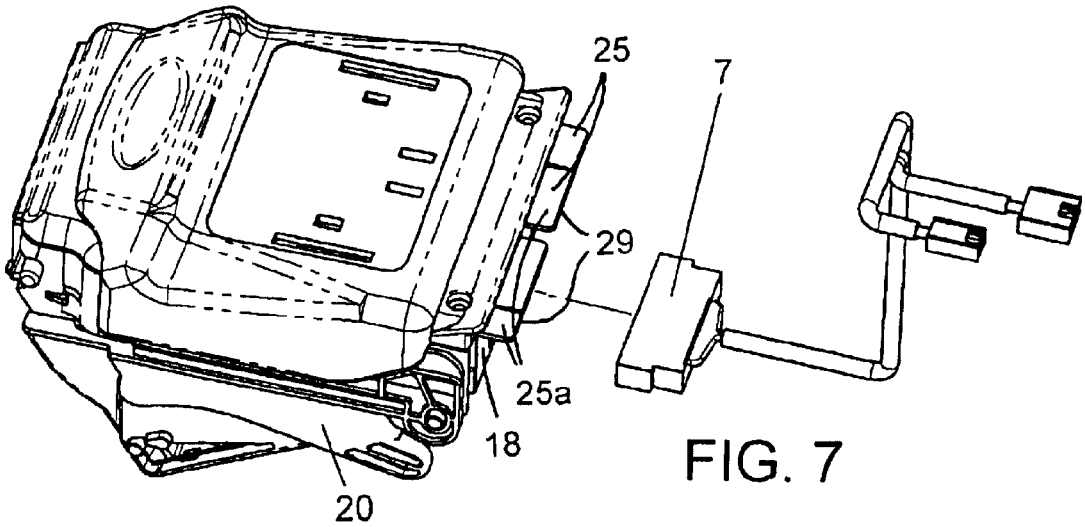
FIG. 7 is an exploded view of a bill acceptor module and a host interface connector in a standalone configuration according to one embodiment of the invention.

As shown in FIGS. 6 and 7, the PCB 29 of the bill acceptor module 20 extends beyond the end of the main enclosure 18 of the bill acceptor module. The PCB 29 contains electrical connections that may be configured as a standard interface 25. These electrical connections may be on an exposed edge of the PCB. Referring to FIGS. 5 and 6, the bill acceptor module 20 may also include a host interface 26. Another portion of the PCB 29 also contains electrical connections that may be configured as a host interface 26. These electrical connections may be on an exposed edge of the PCB. In the implementation shown, the top side 25*a* (see FIG. 7) of an exposed edge of the PCB 29 is the standard interface 25 that provides electrical connections for coupling to an interface board apparatus 30. The opposite side 26*a* (see FIG. 6) of the same exposed edge is part of the host interface 26 that provides electrical connections for coupling the bill acceptor module 20 to a host machine 60. The host interface 26 also uses some electrical connections on the top side 25*a* of the exposed edge that are used for the standard interface. The PCB has a pattern of rectangular pads 19 (see FIG. 6) arranged in a linear array, which may be along an exposed edge, for mechanical and electrical connection to the connector 38. These pads are part of the copper artwork of the PCB 29 and therefore may be implemented at negligible cost.

In addition to the standard and host interfaces, the bill acceptor module 20 may include a USB adapter that is coupled to electrical connections on the PCB. The USB adapter is accessible even when the bill acceptor module is mounted on the frame. That adapter may be used, for example, by service personnel to transmit configuration data to the bill acceptor module.

The bill acceptor module 20 may operate in one of two modes. In a tandem mode, the standard interface 25 is coupled to an interface board apparatus 30 mounted on a frame 50 that is coupled to a host machine 60 to enable operation of the bill acceptor module with the host machine. In this mode, the bill acceptor module 20 may also be coupled to a currency cassette 40 via the interface board apparatus 30. Alternatively, in a standalone mode, the host interface 26 is coupled to a host machine 60 using a host interface connector 7, shown in FIGS. 3 and 4, to enable operation of the bill acceptor module 20 with the host machine 60. In the standalone mode, the configuration of the bill acceptor module 20 is set using the standard interface 25 (e.g., by connecting a service tool to the standard interface). Operation of a device, such as a bill acceptor module, may refer to controlling the behavior of the device (e.g., enabling communication between the device and another device). For example, operation of the bill acceptor module with the host machine may include communication between the bill acceptor module and the host machine.

By suitable design of the PCB 29, the electrical connections may be compatible with a commercially available host interface connector 7, such as an Edge Card Connector manufactured by AMP, which is a division of Tyco International Ltd. (Tyco) of Hampton, Bermuda. In the implementation shown in FIGS. 6 and 7, the host interface connector 7 is able to communicate with a row of contacts on either side of an exposed edge of a PCB. Therefore, the host interface connector 7 may be compatible with the top side 25*a* which corresponds to the standard interface 25, or with the bottom side 26*a* and a portion of the top side which correspond to the host interface. The electrical connection enables operation of the bill acceptor module 20 with the host machine 60. Therefore, it is possible to use portions of the two sets of electrical connections on the same exposed edge of the bill acceptor module's PCB 29 to operate the bill acceptor module 20 in tandem or standalone mode, without requiring modification of the standard interface 32 of the interface board or the host interface connector 7. The PCB 29 may also be designed to provide an interface compatible with any of a variety of adapters (e.g., USB, RS-232, etc.).

Referring to FIGS. 3, 4 and 5, an implementation of an interface board 30 includes an interface PCB coupled to at least a storage means 31, such as a volatile or non-volatile memory and/or a DIP switch and having a standard interface 32 for connection to the bill acceptor module 20, and one or more interfaces 33 for connection to a host machine 60. The interface board may include control circuitry 37, such as a processor or gate array, coupled to the interface PCB to execute instructions stored in the memory. The interface PCB may include electrical connections to connect to other components. These electrical connections may be on one or more edges of the PCB. One portion of the interface PCB may provide the standard interface 32, which provides electrical connections for coupling to the bill acceptor module 20. One or more additional portions of the interface PCB may provide the host machine interface 33, which provides electrical connections for coupling to a host machine 60. The same host interface connector 7 used to couple the bill acceptor module 20 to a host machine 60 in standalone mode may be used to couple the interface board 30 to a host machine 60 in tandem mode.

As explained above, the interface PCB also has a pattern of rectangular pads 35 (see FIG. 3) arranged in a linear array, which may be along an exposed edge. These pads are part of the copper artwork of the PCB and are therefore may be implemented at negligible cost. The interface board apparatus 30 may be one of a plurality of interface board models. Each interface board model may convert at least one host interface to a standard interface that is suitable for operation with a bill acceptor. The interface PCB may also be designed such that one or more electrical connections may be compatible with one of a variety of adapters (e.g., USB, RS-232, etc.). The interface board apparatus 30 may therefore provide a hardware translation between the currency validation assembly 10 and a variety of host machines 60.

Referring again to FIG. 5, the interface board 30 may also include a power supply 34, control means (such as software executing on a processor or a control logic circuit), configuration means 36, such as a storage means 31 (e.g., memory) that stores configuration information, a sensor device 43 and communication means, such as control circuitry 37 which may include a processor or gate array. The communications means may be used to communicate with a currency cassette 40. The currency cassette 40 may include an electrical device 42 and/or an RF tag chip 44 that includes a storage apparatus, such as a memory 41. Additionally, the interface board apparatus 30 may include DIP switches that may be used to configure and store additional configuration data and settings of certain components of a currency validator assembly 10. For example, a DIP switch may be used to configure how the bill acceptor module 20 will accept bills (e.g., one-way, two-way or four-way accept). Hence, the interface board 30 may include components and data necessary to configure the bill acceptor module 20 to operate with a host machine 60.

FIG. 8 is an isometric view of a custom-designed connector 38 which may be mounted to the interface board 30 using fasteners, such as screws, rivets or other equivalent means. The connector 38 includes an array of deformable (spring-like) metallic fingers 81 for frictionally contacting the electrical connection pads 19, 35 (see FIG. 9) on both the standard interface 25 to the interface board of the bill acceptor module 20 and the standard interface 32 to the bill acceptor module of the interface board 30 that correspond to the fingers. Hence, the connector 38 couples the PCB 29 of the bill acceptor module to the interface PCB of the interface board apparatus 30. Alternatively, the connector 38 may be mounted to the bill acceptor module 20. The durability and reliability of the electrical connections formed by the connector 38 may be improved by plating the contact surfaces with a thin layer of a noble metal, such as gold. The service life of the connection may be further improved by adding an intermediate layer of nickel, which acts as a barrier, to prevent diffusion of the copper atoms through the gold. These methods of preventing contact corrosion are known by those skilled in the art.

A bill acceptor module 20 may acquire a static charge before installation into the frame 50. Consequently, the connector 38 may be designed to dissipate any electrostatic discharge that may occur between the standard interface 25 of the bill acceptor module and the standard interface 32 of the interface board. Referring to FIG. 8, the outermost metallic-finger contacts 39*a* and 39*b* in each bank of the connector are raised to ensure that the outermost metallic-finger contacts will touch the corresponding electrical connection pads on an interface 25, 32 before the intermediate metallic-finger contacts 45. The electrical circuits of the interface 25, 32 that correspond to the raised contacts 39*a* and 39*b* of the connector 38 may be ruggedized to withstand any electrostatic discharge that may occur. Alternatively, the standard interface 25 to the interface board and/or the standard interface 32 to the bill acceptor module may be designed to dissipate electrostatic discharge that may occur between them. The outermost electrical connection pads of one or both interfaces 25, 32 may be raised such that they are higher than the other electrical connection pads or elongated such that they are longer than the other connection pads to ensure that the outermost electrical connection pads of the interface will touch the corresponding metallic-finger contacts of a connector before the intermediate electrical connection pads. The electrical circuits of the interface 25, 32 that correspond to the raised or elongated electrical connection pads of the interface may be ruggedized to withstand any electrostatic discharge that may occur. These configurations are useful when the frame 50 and/or case of a host machine 60 are made of a material that is not electrically conductive (such as plastic) and therefore may not provide a connection to ground.

A bill acceptor module 20 according to the disclosed implementation may communicate with a host machine 60 and a currency cassette 40 using an interface board apparatus 30. In one embodiment, control circuitry 27, such as a processor, on the PCB 29 of the bill acceptor module communicates with control circuitry 37, such as a processor, on the interface PCB of the interface board over an SPI bus using an inter-processor communications protocol. The standard interface 32 to the bill acceptor module apparatus of the interface board 30 enables operation with the bill acceptor module 20 and the host interface 33 of the interface board 30 enables operation with a host machine 60. Therefore, the interface board enables operation of the bill acceptor module 20 with the host machine 60.

An external service tool may be used to provide the interface board 30 with configuration data for the bill acceptor module 20. Alternatively, a technician may provide the interface board 30 with the configuration data using a configuration device, such as a bill acceptor module 20, while the interface board is mounted in a frame 50 that is connected to a host machine 60.

Figure 10:
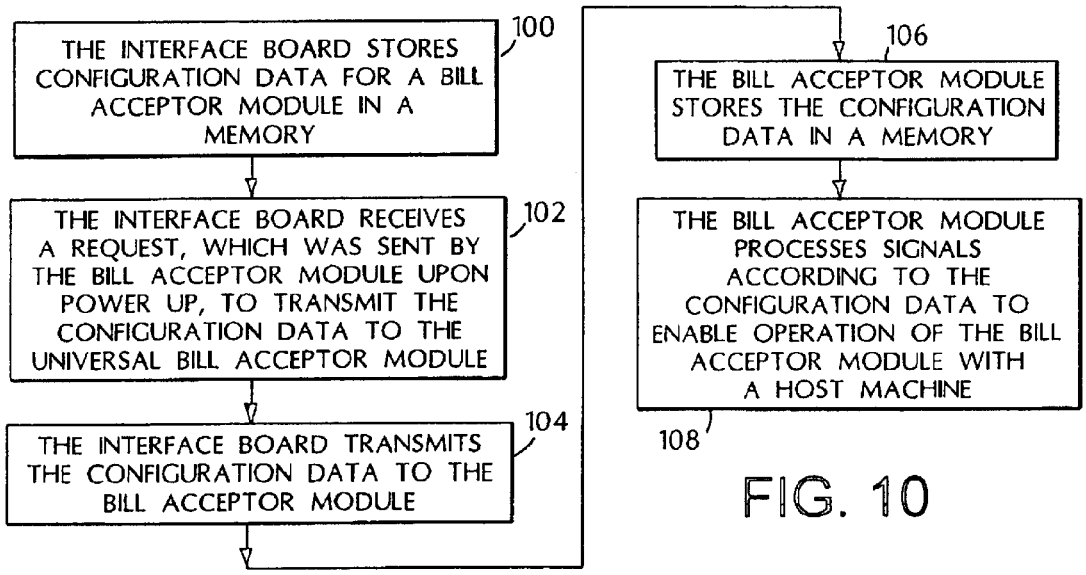
FIG. 10 is a flowchart illustrating the flow of a transfer of configuration data from the interface board apparatus to the bill acceptor module according to one embodiment of the invention.

FIG. 10 is a flow chart illustrating an implementation of the flow of the transfer of configuration data from the interface board to the bill acceptor module. The interface board 30 may store 100 the configuration data for the bill acceptor module 20 in a memory 31, such as a non-volatile memory (e.g., ROM), and transmit 104 the configuration data to the bill acceptor module 20. The bill acceptor module 20 may store 106 this configuration data in a memory 28, such as a volatile memory, (e.g., SRAM), so that the bill acceptor module 20 may access the configuration information locally. The bill acceptor module 20 modifies its behavior by processing signals according to the new configuration data 108 to enable operation with a host machine 60. Additionally, the bill acceptor module 20 may receive configuration data from a variety of sources including a programming tool, such as a coupon or handheld service tool, a plug-in memory chip, a host machine 60, or an RF tag device 44 including a memory 41, on a currency cassette 40. The bill acceptor module 20 may transmit this configuration data to the interface board 30. Therefore, the system provides a bi-directional exchange of information, such as configuration data, from the interface board to the bill acceptor module 20. For example, when a bill acceptor module 20 replaces another bill acceptor in a currency validator assembly 10, a configuring process is not necessary because the bill acceptor module can extract the necessary configuration data from the storage means 31 during initialization.

The configuration data may include information that determines how the bill acceptor module will operate. The configuration data may include, among other things, information regarding a stacker configuration, a power up policy, a bezel type, enabled bill denominations, a bill acceptance method, a banknote series restriction, a user interface and a user interface auto-detect. The stacker configuration information indicates whether the bill acceptor will use an up-stacking or down-stacking configuration for accepted bills. The power up policy information determines how the bill acceptor module will handle currency when power is restored after power fail. The bezel type information describes a portion of the bill acceptor module that funnels a bill or note into the bill acceptor module 20. The enabled bill denominations information determines which bill denominations the bill acceptor module will accept and reject. The bill acceptance method information determines how the bill acceptor module will accept a bill (e.g., one-way, two-way, or four-way acceptance). The banknote series restriction information determines whether the bill acceptor module will restrict notes that were issued prior to a certain date. The user interface information determines the language the bill acceptor module will use in its user interface. The user interface auto-detect information determines whether the bill acceptor module is allowed to use the user interface feature. The configuration data may be specific to at least one of an individual host or host machine type.

The interface board 30 may receive a request 102, which was sent from the bill acceptor module 20 upon power up, to transmit the configuration data of the bill acceptor module. Alternatively, the interface board 30 may broadcast the configuration to the bill acceptor module without a request.

The communication enabled between bill acceptor module 20 and the host machine 60 may include receiving a message from the host machine, which is in the host machine's protocol, in the interface board 30. The interface board may convert this message to a standard protocol and transmit the converted message to the bill acceptor module. Alternatively, after receiving a message from the host machine that is in the host machine's protocol, the interface board may transmit the message in the host machine's protocol to the bill acceptor module. The bill acceptor module may convert the message to a standard protocol.

The present technique may also enable a bill acceptor module to communicate with a memory 41 coupled to a currency cassette 40. The memory may be included on an identification device 44 coupled to the currency cassette. In addition to storing configuration data for a bill acceptor module 20 and transmitting the configuration data to a bill acceptor module, the interface board 30 may receive currency cassette data and transmit the data, which will be received by the bill acceptor module 20. The currency cassette data may include the currency cassette's serial number, number of bills received in the currency cassette 40, the denomination of the bill received and the number of each denomination received. The bill acceptor module 20 may alter its bill acceptance method in response to receiving this information because it will now process signals according to this new information. Additionally, the interface board 30 may receive information for the currency cassette 40 that was transmitted by the bill acceptor module 20 and transmit that information to the currency cassette 40. Therefore, the present technique provides a bi-directional exchange of information between the bill acceptor module 20 and the currency cassette 40.

In one embodiment, the interface board 30 includes a radio frequency (RF) antenna 45 and a sensor device 43. An RF tag chip, such as one manufactured by Philips Corporation, is used as the identification device and may be coupled to the currency cassette 40. The RF tag chip may include a hard-coded version of the currency cassette's serial number in its non-volatile memory 41. The RF tag chip may also include the additional information regarding the number of bills received by the currency cassette 40 that was mentioned above. This auditing feature provides an additional level of security to the currency validator assembly 10. The sensor device 43 of the interface board 30 is used to receive the currency cassette's data from the RF tag chip using RF communications. The interface board 30 also transmits the currency cassette data using RF communications. Additionally, the interface board 30 may receive information for the currency cassette 40 that was transmitted by the bill acceptor module 20 and transmit that information to the currency cassette 40 using RF communications.

In an alternative embodiment, a bill acceptor module 20 may communicate directly with the memory 41 of the identification device on the currency cassette 40. In addition to receiving data transmitted from at least one of an interface board apparatus, a programming tool, a plug-in memory, a memory on a currency cassette and a host machine, storing the configuration data in a memory, and processing signals according to the configuration data to enable communications between a bill acceptor module and a host machine, the bill acceptor module may receive the data described above from a currency cassette and transmit the data described above to a currency cassette. In this embodiment, the bill acceptor module 20 includes the RF antenna and the sensor device. The sensor device of the bill acceptor module is used to receive the currency cassette data from the RF tag chip 44 and transmit the currency cassette data to the RF tag chip using RF communications.

The present technique may also enable a bill acceptor module 20 to communicate with an electrical device 42 coupled to a currency cassette 40. In addition to storing configuration data for a bill acceptor module 20 and transmitting the configuration data to a bill acceptor module, the interface board 30 may receive a request from the bill acceptor module to operate the electrical apparatus 42 on the currency cassette 40 and send the request to the electrical apparatus 42 to perform the requested function or operation. In one embodiment, the electrical apparatus 42 may include an electromechanical lock. The interface board 30 may receive a request, which was sent from the bill acceptor module 20, to lock or unlock the electromechanical lock on the currency cassette 40, and send the request to the electromechanical lock on the currency cassette 40 to perform the requested locking or unlocking function. Alternatively, an electrical device, such as an electromechanical lock, may be coupled to the interface board or frame.

Various features of the system may be implemented in hardware, software, or a combination of hardware and software. Some aspects of the system may be implemented in instructions executing on a machine. For example, some aspects of the system may be implemented in computer programs executing on programmable computers, microprocessors or processors. Each program may be implemented in a high level procedural or object-oriented programming language to communicate with a computer system. Furthermore, each such computer program may be stored on a storage medium, such as read-only-memory (ROM) readable by a general or special purpose programmable computer, for configuring and operating the computer when the storage medium is read by the computer to perform the functions described above.

A number of embodiments of the invention have been described. Nevertheless, it will be understood that various modifications may be made without departing from the spirit and scope of the invention. For example, the bill acceptor module 20 may include more than one processor. Also, the memory of the bill acceptor module 20 and the memory of the interface board 20 may include volatile or non-volatile memory. This memory may be socketed or embedded in a processor. Accordingly, other embodiments are within the scope of the following claims.

What is claimed is:

1. A method comprising:

storing configuration data for a bill acceptor module in a memory of an interface board; and transmitting the configuration data to the bill acceptor module to enable operation of the bill acceptor module with a host machine.

2. The method of claim 1 further comprising receiving a request from the bill acceptor module to transmit the configuration data.

3. The method of claim 1 further comprising receiving configuration data transmitted from the bill acceptor module, said configuration data received by the bill acceptor module from at least one of a plurality of sources.

4. The method of claim 1 wherein the configuration data is specific to at least one of a host machine type or an individual host machine.

5. The method of claim 1 wherein the operation of the bill acceptor module with the host machine comprises:

receiving a message in host machine protocol;

converting the message to a standard protocol; and transmitting the message to the bill acceptor module in the standard protocol.

6. The method of claim 1 further comprising:

receiving currency cassette data in an interface board apparatus; and transmitting the data from the interface board apparatus to the bill acceptor module.

7. The method of claim 6 wherein RF communications are used to receive the currency cassette data.

8. The method of claim 6 further comprising:

receiving information for the currency cassette from the bill acceptor module; and transmitting the information to the currency cassette.

9. The method of claim 8 wherein transmitting the information to the currency cassette is performed using RF communications.

10. The method of claim 1 further comprising:

receiving a request from a bill acceptor module to operate an electrical apparatus on a currency cassette; and sending a request to the electrical apparatus on the currency cassette to perform a function.

11. The method of claim 10 wherein the electrical apparatus is an electro-mechanical lock.

12. The method of claim 1 wherein the configuration data indicates how the bill acceptor is to operate.

13. A method comprising:

receiving configuration data transmitted from at least one of an interface board apparatus, a programming tool, a plug-in memory, a memory on a currency cassette, and a host machine;

storing the configuration data in a memory; and processing signals according to the configuration data to enable operation of a bill acceptor module with the host machine.

14. The method of claim 13 further comprising sending a request to the interface board apparatus to transmit the configuration data.

15. The method of claim 13 further comprising:

receiving configuration data from at least one of a plurality of sources; and transmitting the configuration data to the interface board apparatus.

16. The method of claim 13 wherein the operation of the bill acceptor module with the host machine comprises:

receiving a message from an interface board apparatus according to a host machine protocol; and converting the message to a standard protocol.

17. The method of claim 13 further comprising receiving currency cassette data from the interface board apparatus.

18. The method of claim 13 further comprising transmitting information from the bill acceptor module to the currency cassette via the interface board apparatus.

19. The method of claim 13 further comprising receiving data from a currency cassette or transmitting data to a currency cassette.

20. The method of claim 19 wherein RF communications are used to receive or transmit the data.

21. The method of claim 13 further comprising sending a request to an interface board apparatus to operate an electrical apparatus.

22. The method of claim 21 wherein the electrical apparatus includes a currency cassette electromechanical lock and wherein the request includes at least one of locking and unlocking the electromechanical lock.

23. An interface board apparatus comprising:

an interface printed circuit board with electrical connections for coupling a bill acceptor module to a host machine;

control circuitry coupled to the interface printed circuit board;

a memory, coupled to the interface printed circuit board, for storing information that, when applied to the control circuitry, causes the control circuitry to:

store configuration data for a bill acceptor module in a memory of an interface board; and transmit the configuration data to the bill acceptor module to enable operation of the bill acceptor module with the host machine.

24. The apparatus of claim 23 wherein the electrical connections of the printed circuit board are compatible with at least one of many types of adapters.

25. The apparatus of claim 23 wherein the interface board is one of a plurality of interface board models, each of said models being capable of converting one or more host interfaces to a standard interface.

26. The apparatus of claim 23 wherein the configuration data includes information regarding at least one of a stacker configuration, power up policy, bezel type, enabled bill denominations, bill acceptance method, banknote series restriction, user interface and user interface auto-detect.

27. The apparatus of claim 23 further comprising DIP switches to set and store configuration data.

28. The apparatus of claim 23 wherein the memory further includes at least one of instructions to cause the control circuitry to receive a request from the bill acceptor module to transmit the configuration data and instructions to cause the control circuitry to receive configuration data transmitted from the bill acceptor module.

29. The apparatus of claim 23 further comprising a connector mounted on the interface printed circuit board for connection to a printed circuit board of a bill acceptor module.

30. The apparatus of claim 29 wherein the connector includes an array of spring-like metallic fingers for contacting at least one of the electrical connections on the interface printed circuit board and electrical connections on the printed circuit board of the bill acceptor module.

31. The apparatus of claim 30 wherein at least one outermost metallic finger is raised to make contact with a corresponding electrical connection on a printed circuit board before any of the other metallic fingers make contact.

32. The apparatus of claim 31 wherein an electrical circuit on the printed circuit board corresponding to the outermost metallic finger is ruggedized to withstand electrostatic discharge.

33. The apparatus of claim 23 wherein at least one outermost electrical connection pad of the interface printed circuit board is raised, such that it is higher than other electrical connection pads, to make contact with a corresponding metallic finger on a connector before any other electrical connection pad makes contact.

34. The apparatus of claim 33 wherein an electrical circuit on the interface printed circuit board corresponding to the raised pad is ruggedized to withstand electrostatic discharge.

35. The apparatus of claim 23 wherein at least one outermost electrical connection pad of the interface printed circuit board is elongated, such that it is longer than the other electrical connection pads, to make contact with a corresponding metallic finger on a connector before any other electrical connection pad makes contact.

36. The apparatus of claim 35 wherein an electrical circuit on the interface printed circuit board corresponding to the elongated pad is ruggedized to withstand electrostatic discharge.

37. The apparatus of claim 23 wherein the memory further includes instructions to cause the control circuitry to:

receive currency cassette data in an interface board apparatus; and transmit the data from the interface board apparatus to the bill acceptor module.

38. The apparatus of claim 37 further comprising an RF antenna coupled to the interface board for receiving currency cassette data or transmitting data to the currency cassette using RF communications.

39. A bill acceptor module apparatus comprising:

a printed circuit board with electrical connections to couple to an interface board apparatus;

control circuitry coupled to the printed circuit board;

a memory, coupled to the printed circuit board for storing information that, when applied to the control circuitry, causes the control circuitry to:

receive configuration data transmitted from at least one of an interface board apparatus, a programming tool, a plug-in memory, a memory on a currency cassette, and a host machine;

store the configuration data in a memory; and process signals according to the configuration data to enable operation of the bill acceptor module with a host machine.

40. The apparatus of claim 39 wherein the electrical connections of the printed circuit board are compatible with at least one of many types of connectors.

41. The apparatus of claim 39 further comprising a USB adapter coupled to the electrical connections of the printed circuit board, said USB adapter is accessible even when the bill acceptor module is mounted to the frame.

42. The apparatus of claim 39 further comprising a connector mounted on the printed circuit board for connection to an interface printed circuit board of an interface board apparatus.

43. The apparatus of claim 42 wherein the connector includes an array of spring-like metallic fingers for contacting at least one of the electrical connections on the interface printed circuit board of the interface board apparatus and the electrical connections on the printed circuit board of the bill acceptor module.

44. The apparatus of claim 43 wherein at least one outermost metallic finger is raised to make contact with a corresponding electrical connection on a printed circuit board before any of the other metallic fingers make contact.

45. The apparatus of claim 44 wherein an electrical circuit on a printed circuit board corresponding to the outermost metallic finger is ruggedized to withstand electrostatic discharge.

46. The apparatus of claim 39 wherein at least one outermost electrical connection pad of the printed circuit board is raised, such that it is higher than other electrical connection pads, to make contact with a corresponding metallic finger on a connector before any other electrical connection pad makes contact.

47. The apparatus of claim 46 wherein an electrical circuit on the interface printed circuit board corresponding to the raised pad is ruggedized to withstand electrostatic discharge.

48. The apparatus of claim 39 wherein at least one outermost electrical connection pad of the printed circuit board is elongated, such that it is longer than other electrical connection pads, to make contact with a corresponding metallic finger on a connector before any other electrical connection pad makes contact.

49. The apparatus of claim 48 wherein an electrical circuit on the interface printed circuit board corresponding to the elongated pad is ruggedized to withstand electrostatic discharge.

50. The apparatus of claim 39 wherein the printed circuit board further includes electrical connections to couple directly to a host machine and wherein the memory further includes instructions to cause the control circuitry to communicate directly with the host machine.

51. The apparatus of claim 50 wherein the bill acceptor module utilizes a standard interface to receive its configuration data.

52. The apparatus of claim 50 further comprising an Edge card connector for connection to the electrical connections to couple directly to a host machine and for connection to a host machine.

53. A system comprising:

a frame;

an interface board removably mounted in the frame including an interface printed circuit board with electrical connections, control circuitry and associated memory coupled to the interface printed circuit board, wherein the memory stores information that causes the control circuitry to store configuration data for a bill acceptor module in a memory of an interface board, and to transmit the configuration data to the bill acceptor module to enable operation of the bill acceptor module with a host machine;

a bill acceptor module including a printed circuit board with electrical connections to couple to the interface board, control circuitry and associated memory coupled to the printed circuit board, wherein the memory stores information that causes the control circuitry to receive configuration data transmitted from at least one of an interface board, a programming tool, a plug-in memory chip, a memory on a currency cassette, and a host machine, store the configuration data, and process signals according to the configuration data to enable operation of the bill acceptor module with the host machine.

54. The system of claim 53 wherein the configuration data includes information regarding at least one of a stacker configuration, power up policy, bezel type, enabled bill denominations, bill acceptance method, banknote series restriction, user interface and user interface auto-detect.

55. The system of claim 53 wherein the interface board further comprises DIP switches to set and store configuration data.

56. The system of claim 53 wherein the memory of the interface board further includes at least one of instructions to cause the control circuitry to receive a request from the bill acceptor module to transmit the configuration data and instructions to cause the control circuitry to receive configuration data transmitted from the bill acceptor module.

57. The system of claim 53 further comprising a connector mounted on the interface printed circuit board for connection to a printed circuit board of a bill acceptor module.

58. The system of claim 57 wherein the connector includes an array of spring-like metallic fingers.

59. The system of claim 58 wherein at least one outermost metallic finger is raised to make contact with a corresponding electrical connection on a printed circuit board before any of the other metallic fingers make contact.

60. The system of claim 59 wherein an electrical circuit on the printed circuit board corresponding to the outermost metallic finger is ruggedized to withstand electrostatic discharge.

61. The system of claim 53 further comprising:

a currency cassette; and a memory coupled to the currency cassette.

62. The system of claim 61 further comprising:

an RF antenna coupled to the interface board apparatus; and a sensor device coupled to the interface board for receiving or transmitting currency cassette data.

63. The system of claim 53 further comprising:

an RF antenna coupled to the bill acceptor module; and a sensor device coupled to the bill acceptor module for receiving or transmitting currency cassette data.

64. The system of claim 53 further comprising:

a currency cassette; and an electrical apparatus coupled to the currency cassette.

65. The system of claim 64 wherein the electrical apparatus is an electromechanical lock.

66. The system of claim 53 further comprising an electrical apparatus coupled to one of the interface board or the frame.

67. The system of claim 66 wherein the electrical apparatus is an electromechanical lock.

68. The system of claim 53 wherein the printed circuit board of the bill acceptor module apparatus further includes electrical connections to couple directly to a host machine.

69. The system of claim 68 wherein the same host interface connector is used when the electrical connections of the interface board are used to connect to a host machine and when the electrical connections of the bill acceptor module's printed circuit board are used to connect to a host machine.

70. An article comprising a storage medium having stored instructions that, when executed by a machine, cause the machine to:

store configuration data for a bill acceptor module in a memory of an interface board; and transmit the configuration data to the bill acceptor module to enable operation of the bill acceptor module with a host machine.

71. The article of claim 70 further including instructions that cause the machine to receive a request from the bill acceptor module to transmit the configuration data.

72. The article of claim 70 further including instructions that cause the machine to receive configuration data transmitted from the bill acceptor module, said configuration data received by the bill acceptor module from at least one of a plurality of sources.

73. The article of claim 70 further including instructions that cause the machine to:

receive a message in a host machine protocol;

convert the message to a standard protocol; and transmit the message to the bill acceptor module in the standard protocol.

74. The article of claim 70 further including instructions that cause the machine to:

receive currency cassette data in an interface board apparatus; and transmit the data from the interface board apparatus to the bill acceptor module to enable communications between a bill acceptor module and a currency cassette.

75. The article of claim 74 further including instructions that cause the machine to:

receive information for the currency cassette from the bill acceptor module; and transmit the information to the currency cassette.

76. The article of claim 70 further including instructions that cause the machine to:

receive a request from a bill acceptor module to operate an electrical apparatus on a currency cassette; and send a request to the electrical apparatus on the currency cassette to perform a function.

77. An article comprising a storage medium having stored instructions that, when executed by a machine, cause the machine to:

receive configuration data transmitted from at least one of an interface board apparatus, a programming tool, a plug-in memory, a memory on a currency cassette, and a host machine;

store the configuration data in a memory; and process signals according to the configuration data to enable operation of a bill acceptor module with a host machine.

78. The article of claim 77 further including instructions that cause the machine to send a request to the interface board apparatus to transmit the configuration data.

79. The article of claim 77 further including instructions that cause the machine to:

receive configuration data from at least one of a plurality of sources; and transmit the configuration data to the interface board apparatus.

80. The article of claim 77 further including instructions that cause the machine to:

receive a message from an interface board apparatus according to a host machine protocol; and convert the message to a standard protocol.

81. The article of claim 77 further including instructions that cause the machine to receive currency cassette data from the interface board apparatus.

82. The article of claim 80 further including instructions that cause the machine to transmit information from the bill acceptor module to the currency cassette via the interface board apparatus.

83. The article of claim 77 further including instructions that cause the machine to receive data from a currency cassette or transmit data to a currency cassette.

84. The article of claim 77 further including instructions that cause the machine to send a request to an interface board apparatus to operate an electrical apparatus.

85. The article of claim 84 wherein the request includes at least one of locking and unlocking an electromechanical lock.

* * * * *